US009222152B2

(12) United States Patent
Abe et al.

(10) Patent No.: US 9,222,152 B2
(45) Date of Patent: Dec. 29, 2015

(54) ALUMINUM—MAGNESIUM ALLOY AND ALLOY PLATE THEREOF

(71) Applicant: Kobe Steel, Ltd., Kobe-shi (JP)

(72) Inventors: Mitsuhiro Abe, Moka (JP); Makoto Morishita, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/352,240

(22) PCT Filed: Nov. 15, 2012

(86) PCT No.: PCT/JP2012/079672
§ 371 (c)(1),
(2) Date: Apr. 16, 2014

(87) PCT Pub. No.: WO2013/077251
PCT Pub. Date: May 30, 2013

(65) Prior Publication Data

US 2014/0255249 A1 Sep. 11, 2014

(30) Foreign Application Priority Data

Nov. 21, 2011 (JP) ..... 2011-254339
Oct. 23, 2012 (JP) ..... 2012-233540

(51) Int. Cl.

| | |
|---|---|
| ***C22C 21/06*** | (2006.01) |
| ***C22C 21/08*** | (2006.01) |
| ***C22F 1/00*** | (2006.01) |
| ***C22F 1/047*** | (2006.01) |

(52) U.S. Cl.
CPC ..... *C22C 21/06* (2013.01); *C22C 21/08* (2013.01); *C22F 1/00* (2013.01); *C22F 1/047* (2013.01)

(58) Field of Classification Search
CPC ..... C22C 21/06; C22C 21/08
USPC ..... 420/542, 546
See application file for complete search history.

(56) References Cited

U.S. PATENT DOCUMENTS

| | | | | |
|---|---|---|---|---|
| 6,969,432 | B2 * | 11/2005 | Raynaud et al. | 420/542 |
| 8,025,093 | B2 * | 9/2011 | Morishita | 164/480 |
| 8,420,011 | B2 * | 4/2013 | Morishita et al. | 420/542 |
| 2013/0112323 | A1 | 5/2013 | Abe et al. | |
| 2013/0312876 | A1 * | 11/2013 | Palm | 148/549 |

FOREIGN PATENT DOCUMENTS

| | | |
|---|---|---|
| CN | 103842536 A | 6/2014 |
| JP | 4 236737 | 8/1992 |
| JP | 6 158210 | 6/1994 |

(Continued)

OTHER PUBLICATIONS

Abstract of JP 2004/143511; May 2004.*
English translation of JP 06/158210; Jun. 1994; 16 pages.*
English translation of JP 2012/197510; Oct. 2012; 19 pages.*
Yanagisawa, et al., "Keikinzoku (Light metals)", The Journal of Japan Institute of Light Metals, No. 21, pp. 68-72, (1956).

(Continued)

*Primary Examiner* — Helene Klemanski
(74) *Attorney, Agent, or Firm* — Oblon, McClelland, Maier & Neustadt, L.L.P.

(57) ABSTRACT

An aluminum-magnesium alloy capable of suppressing molten metal oxidation even without adding Be, and an alloy plate of the aluminum magnesium alloy, are characterized by being obtained by adding 0.20 mass % or more of Cr and/or 0.002 mass % or more of Ca to an aluminum-magnesium alloy which contains 0.8-15 mass % Mg and, as an unavoidable impurity, 0.001 mass % or more of P.

13 Claims, 3 Drawing Sheets

(56) References Cited

FOREIGN PATENT DOCUMENTS

| | | |
|---|---|---|
| JP | 2004 143511 | 5/2004 |
| JP | 2008 260975 | 10/2008 |
| JP | 2010 180422 | 8/2010 |
| JP | 2012 197510 | 10/2012 |
| WO | WO 2012/075993 A2 * | 6/2012 |

OTHER PUBLICATIONS

International Search Report Issued Dec. 25, 2012 in PCT/JP12/079672 Filed Nov. 15, 2012.

Written Opinion of the International Searching Authority Issued Dec. 25, 2012 in PCT/JP12/079672 Filed Nov. 15, 2012.

* cited by examiner

| | EXAMPLE 2-1 |
|---|---|
| LOW-MAGNIFICATION SEM |   |
| HIGH-MAGNIFICATION SEM |   |

| | EXAMPLE 2-2 |
|---|---|
| LOW-MAGNIFICATION SEM |   |
| HIGH-MAGNIFICATION SEM |   |

| | EXAMPLE 2-7 |
|---|---|
| LOW-MAGNIFICATION SEM |   |
| HIGH-MAGNIFICATION SEM |   |

ALUMINUM—MAGNESIUM ALLOY AND ALLOY PLATE THEREOF

TECHNICAL FIELD

The present invention relates to an aluminum-magnesium alloy and an alloy plate thereof and more particularly to an aluminum-magnesium alloy and an alloy plate thereof manufactured by using raw materials containing P as an unavoidable impurity.

BACKGROUND ART

When exposed to the atmosphere, molten aluminum is easily oxidized and forms inclusions, such as large amounts of oxides. Examples of the inclusions include oxides, such as $Al_2O_3$, MgO, $MgAl_2O_4$, $SiO_2$, silicates, Al.Si.O, FeO, and $Fe_2O_3$, carbides ($Al_4C_3$, $Al_4O_4C$, graphite carbon), borides ($AlB_2$, $AlB_{12}$, $TiB_2$, $VB_2$), $Al_3Ti$, $Al_3Zr$, $CaSO_4$, AlN, and various halides.

Since the free energy of formation of a Mg oxide is lower than the free energy of formation of an Al oxide, it is believed that Mg of a molten aluminum-magnesium alloy (an aluminum-magnesium alloy is hereinafter also referred to as an Al—Mg alloy) is preferentially oxidized and forms MgO (magnesia) or $Al_2O_3$—MgO (spinel). Because of the high wettability of the oxides to a molten Al—Mg alloy (hereinafter also referred to as a molten metal), the oxides are present in the molten metal as precipitated or suspended inclusions.

These inclusions in a molten metal finally become nonmetallic inclusions, which impair the quality of products, such as wrought materials, forged products, and die-casting products.

Thus, an in-line treatment, such as a treatment of a molten metal in a furnace using a gas or flux, filtration, or a rotating nozzle treatment, may be performed to remove inclusions from a molten metal in a melting furnace or a holding furnace or in another production step.

In a process for transferring a molten metal from a treatment bath to a casting mold after the treatment and a process for casting the molten metal in the casting mold, however, the molten metal is exposed to the atmosphere, and an oxide is formed on the molten metal surface.

Thus, in order to prevent Mg of an Al—Mg alloy from being oxidized in a molten metal, a few parts per million of beryllium (Be) is generally added to the Al—Mg alloy. Such a treatment suppresses the formation of MgO and $Al_2O_3$—MgO (Non-patent Literature 1).

However, workers who continuously inhale a fine powder or fumes of Be may suffer from chronic respiratory dysfunction. The addition of Be must therefore be suppressed in consideration of the health of workers and work environment.

With increasing awareness of recycling from the perspective of energy conservation and low environmental load, some Al—Mg alloys are manufactured by using raw materials containing a given amount of P derived from aluminum scrap. Thus, there is a demand for a technique for suppressing molten metal oxidation even when such raw materials containing a given amount of P are used.

A method for suppressing the molten metal oxidation of Mg in an Al—Mg alloy without the addition of Be is proposed in Patent Literature 1. More specifically, oxygen supply from Bi to Mg is suppressed by lowering the bismuth (Bi) content of an Al—Mg alloy to 30 ppm (0.003 mass %) or less and thereby reducing the amount of Bi on a molten metal surface. Furthermore, the molten metal surface is covered with an Al or Mg oxide film having a low oxygen diffusion velocity in order to suppress the formation of MgO in the molten metal.

CITATION LIST

Patent Literature

PTL 1: Japanese Unexamined Patent Application Publication No. 2008-260975 Non Patent Literature NPL 1: "Keikinzoku (Light metals)", The Japan Institute of Light Metals, No. 21 (1956), p. 68

SUMMARY OF INVENTION

Technical Problem

However, industrially widely used Al and Mg virgin ingots or aluminum scrap used as a raw material for recycled aluminum do not contain Bi as an impurity, and the Bi content of Al—Mg alloys manufactured by using conventional raw materials is 30 ppm (0.003 mass %) or less. Thus, Al—Mg alloys having a limited Bi content of 30 ppm or less are not different from known Al—Mg alloys.

Even in the case of Al—Mg alloys having a Bi content of 30 ppm or less, many inclusions are formed through molten metal oxidation. This will be described in detail below.

Thus, the related art described in Patent Literature 1 cannot sufficiently suppress molten metal oxidation.

In view of the situations described above, it is an object of the present invention to provide an aluminum-magnesium alloy that is resistant to molten metal oxidation without the addition of Be and an alloy plate of the aluminum-magnesium alloy.

Solution to Problem

Since the free energy of formation of a Mg oxide is lower than the free energy of formation of an Al oxide, it is believed that Mg of a molten Al—Mg alloy is preferentially oxidized and forms MgO or $Al_2O_3$—MgO. The present inventors studied this phenomenon to solve the problems described above.

As a result of extensive studies on the mechanism of molten metal oxidation, the present inventors found that molten metal oxidation depends greatly on the presence of phosphorus (P) in a molten Al—Mg alloy. More specifically, it was found that an excessive amount of P in a molten Al—Mg alloy forms a compound with Mg (hereinafter also referred to as Mg phosphide), and the Mg phosphide floats in the molten metal, is oxidized in the ambient atmosphere, and forms a complex oxide of Mg and P (hereinafter also referred to as a Mg—P oxide). However, it was found that not more than a certain amount of P in a molten Al—Mg alloy negligibly forms a Mg—P oxide through molten metal oxidation.

It was also found that the Mg—P oxide has high wettability to a molten metal and is present as a precipitated or suspended inclusion in the molten metal. This is because the free energy of formation of an oxide of a compound of Mg and P is lower than that of a compound of Al and P, and the compound of Mg and P can be more stably present in a molten metal than the compound of Al and P. Furthermore, the compound of Mg and P has a lower specific gravity than molten Al and floats in the molten metal.

There is a technique that is focused on the presence of P in a molten Al—Mg alloy, and attempts have been made to remove P (a P compound) from a molten metal.

For example, there is a method for filtering out an Al—P compound in a molten metal at a particular temperature (Japanese Unexamined Patent Application Publication No. 4-276031) or a method for blowing MgO and oxygen into a molten metal to form a P oxide or a Mg—P oxide and removing the P oxide or the Mg—P oxide (Japanese Unexamined Patent Application Publication No. 7-207366). However, these methods not only are uneconomical because of significant aluminum loss but also take an excessively long filtration time. Thus, these methods cannot be practically used.

There is also a method for adding Mg to a molten metal, blowing chlorine gas or a chloride into the molten metal to float a compound of P and Mg, and removing the compound of P and Mg (Japanese Patent No. 3524519). This method also not only is uneconomical because of significant aluminum loss but also uses an increased amount of chlorine. Thus, the method is difficult to practically use. Furthermore, chlorine gas or a chloride may damage the health of workers. Thus, the method is undesirable also in terms of the health of workers and work environment.

In view of these considerations, the present inventors have come up with the present invention.

An aluminum-magnesium alloy according to the present invention contains 0.8 to 15 mass % Mg and 0.001 mass % or more P as an unavoidable impurity, wherein at least one of 0.20 mass % or more Cr and 0.002 mass % or more Ca is added to the aluminum-magnesium alloy.

In an aluminum-magnesium alloy containing P according to the present invention, a predetermined amount of Cr and/or Ca added to the aluminum-magnesium alloy preferentially binds P (forming Cr phosphide or Ca phosphide) and reduces the percentage of P that binds Mg. This can suppress the formation of Mg phosphide and consequently suppress the formation of a Mg—P oxide (an inclusion). In other words, a Mg—P oxide is negligibly formed in a molten metal, and molten metal oxidation can be suppressed.

The manufacture of an aluminum-magnesium alloy according to the present invention simply involves the addition of Cr and/or Ca and does not involve an additional process, such as filtration. The manufacture of an aluminum-magnesium alloy according to the present invention does not cause aluminum or magnesium loss. Thus, an aluminum-magnesium alloy according to the present invention is suitable for practical use.

An aluminum-magnesium alloy plate (for use in a thick plate) according to the present invention is made of an aluminum-magnesium alloy according to the present invention and has a Mg content in the range of 1.0 to 5.5 mass %.

In an aluminum-magnesium alloy plate containing P (for use in a thick plate) according to the present invention, Cr and/or Ca in the aluminum-magnesium alloy can preferentially bind P and suppress the formation of a Mg—P oxide (an inclusion).

An aluminum-magnesium alloy plate (for use in a thick plate) according to the present invention preferably has a Mg content in the range of 1.0 to 2.5 mass %.

In an aluminum-magnesium alloy plate (for use in a thick plate) according to the present invention, the Mg content is limited to a predetermined value or less to improve corrosion resistance.

An aluminum-magnesium alloy plate (for use in shape processing) according to the present invention is made of an aluminum-magnesium alloy according to the present invention and has a Mg content in the range of 6.0 to 15.0 mass %.

In an aluminum-magnesium alloy plate containing P (for use in shape processing) according to the present invention, Cr and/or Ca in the aluminum-magnesium alloy can preferentially bind P and suppress the formation of a Mg—P oxide (an inclusion). As a result, surface defects, such as a "shrinkage cavity", caused by the Mg—P oxide can be avoided.

Advantageous Effects of Invention

In an aluminum-magnesium alloy according to the present invention and an alloy plate thereof, little Mg—P oxide is formed in a molten metal, and molten metal oxidation can be suppressed. As a result, a high-quality aluminum-magnesium alloy containing few inclusions and an alloy plate thereof can be provided.

DESCRIPTION OF EMBODIMENTS

Figure 1:
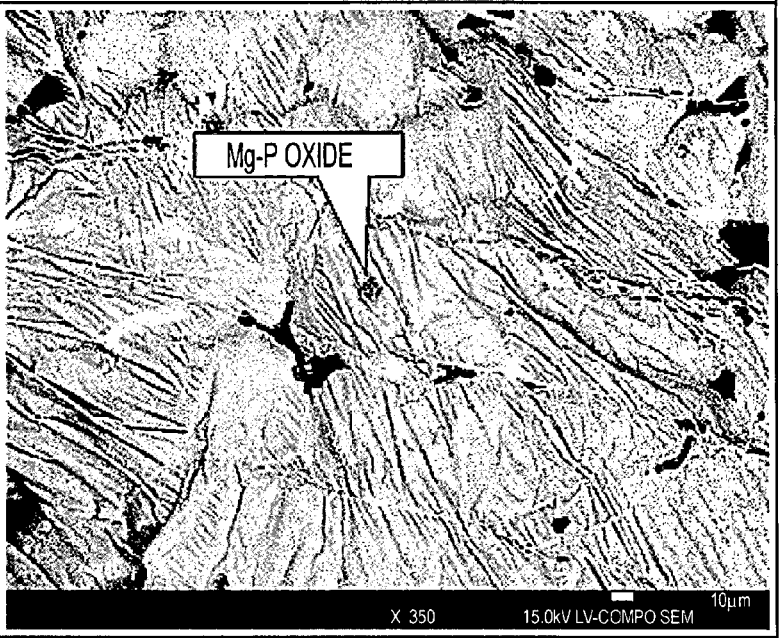
FIG. 1 shows images of a molten metal surface of a solidified sample taken with a scanning electron microscope after an aluminum-magnesium alloy plate according to an example of the present invention was held at 730° C. in the ambient atmosphere for one hour.
Figure 1:
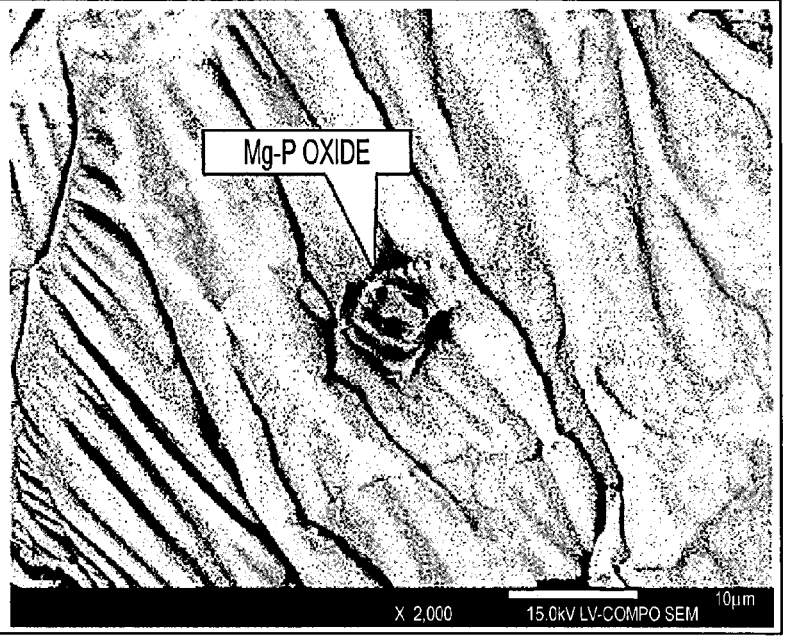

Embodiments of an aluminum-magnesium alloy according to the present invention and an alloy plate thereof will be described in detail below.

[Aluminum-Magnesium Alloy]

An aluminum-magnesium alloy according to an embodiment of the present invention contains a predetermined amount of Mg and P as an unavoidable impurity, wherein at least one of 0.20 mass % or more Cr and 0.002 mass % or more Ca is added to the aluminum-magnesium alloy.

The following are the reasons for limiting the components of an aluminum-magnesium alloy according to an embodiment of the present invention.

(Mg: 0.8 to 15 mass %)

Mg is an essential element for imparting high strength and proof stress to a final plate product or a final extrudate.

A Mg content of less than 0.8 mass % results in insufficient strength and proof stress of a final plate product or a final extrudate. A Mg content of more than 15 mass % results in the formation of a casting crack due to the segregation of Mg, which makes ingot making difficult. Thus, such a Mg content is not suitable for product processing.

Thus, the Mg content ranges from 0.8 to 15 mass %.

(P: Unavoidable Impurity)

P is an impurity element.

A P content of a certain value or more results in accelerated formation of a Mg—P oxide and poor quality of a final plate product or a final extrudate, as described above.

More specifically, a P content of 0.001 mass % or more often results in the formation of a large amount of Mg—P oxide (an inclusion) and the occurrence of a crack or a shrinkage cavity in a final plate product or a final extrudate. In other words, among Al—Mg alloys containing P, P must particularly be removed (decreased) from Al—Mg alloys having a P content of 0.001 mass % or more.

Thus, the present invention is preferably applied to Al—Mg alloys having a P content of 0.001 mass % or more and has significant advantages in such Al—Mg alloys.

In general, P constitutes 0.0005 to 0.01 mass % (5 to 100 ppm) or more of aluminum scrap, such as outside company scrap or return scrap. Thus, Al—Mg alloys containing a large amount of aluminum scrap inevitably have a P content of 0.001 mass % (10 ppm) or more.

Thus, the present invention is preferably applied to Al—Mg alloys containing aluminum scrap and has particular advantages in such Al—Mg alloys.

The upper limit of the P content is not particularly limited. Since Al—Mg alloys entirely composed of aluminum scrap (can ends) alone have a P content of 100 ppm, the upper limit of the P content is generally 100 ppm or less. The present invention can be applied to Al—Mg alloys having a P content of 100 ppm or less.

(Cr: 0.20 Mass % or More)

Cr binds P in an Al—Mg alloy (molten metal) and forms Cr phosphide.

The addition of 0.20 mass % or more Cr to an Al—Mg alloy allows Cr to preferentially bind P (forming Cr phosphide), reduce the percentage of P that binds Mg, and suppress the formation of a Mg—P oxide. Thus, Cr can prevent deterioration in the quality of a final plate product or a final extrudate. The addition of less than 0.20 mass % Cr to an Al—Mg alloy cannot sufficiently suppress the formation of a Mg—P oxide.

Thus, the amount of Cr to be added to an Al—Mg alloy is 0.20 mass % or more.

The upper limit of the amount of Cr to be added is not particularly limited. Considering that a coarse intermetallic compound $(Mn, Cr)Al_7$ crystallizes out as a primary crystal, the upper limit of the amount of Cr to be added is preferably 0.3 mass % or less.

(Ca: 0.002 Mass % or More)

Ca binds P in an Al—Mg alloy (molten metal) and forms Ca phosphide.

The addition of 0.002 mass % or more Ca to an Al—Mg alloy allows Ca to preferentially bind P (forming Ca phosphide), reduce the percentage of P that binds Mg, and suppress the formation of a Mg—P oxide. Thus, Ca can prevent deterioration in the quality of a final plate product or a final extrudate. Such effects are insufficient when the amount of Ca added to an Al—Mg alloy is less than 0.002 mass %.

Thus, the amount of Ca to be added to an Al—Mg alloy is 0.002 mass % or more.

The upper limit of the amount of Ca to be added is not particularly limited. Considering the occurrence of an edge crack in hot rolling, the upper limit of the amount of Ca to be added is preferably 0.1 mass % or less.

Although the addition of at least one of the above amounts of Cr and Ca can suppress the molten metal oxidation of an Al—Mg alloy, the addition of both Cr and Ca can also have the same effects.

(Total Aluminum and Magnesium Content: 90 Mass % or More)

When the total aluminum and magnesium content of an Al—Mg alloy is 90 mass % or more, the amounts of other undefined elements in the Al—Mg alloy can be reduced. This can reduce the effects of the other elements and effectively suppress molten metal oxidation. When the total aluminum and magnesium content of an Al—Mg alloy is less than 90 mass %, the Al—Mg alloy contains large amounts of elements other than Mg. Thus, because of increased effects of the other elements, molten metal oxidation can be insufficiently suppressed.

Thus, the total aluminum and magnesium content is preferably 90 mass % or more.

(Other Components)

In addition to the components described above, an aluminum-magnesium alloy according to an embodiment of the present invention contains Si, Fe, Cu, Mn, and/or Zn in accordance with the intended use and Al and unavoidable impurities as the remainder. The amount of each of the other components is preferably not more than 5 mass %.

[Method for Producing Aluminum-Magnesium Alloy]

An aluminum-magnesium alloy according to an embodiment of the present invention is produced by melting an alloy (raw material) containing predetermined amount of Mg and an unavoidable impurity P to prepare a molten metal, subjecting the molten metal to molten metal treatment, such as degassing treatment and/or inclusion removal treatment, and pouring the molten metal into a mold. Cr and/or Ca may be added to the alloy (raw material) in any process before the alloy is poured into the mold.

An alloy plate made of an aluminum-magnesium alloy according to an embodiment of the present invention will be described below.

[Aluminum-Magnesium Alloy Plate for Use in Thick Plate]

When Al—Mg alloys manufactured by using raw materials containing aluminum scrap are used as plate materials for thick plates, the presence of an excessive amount of P results in a great number of inclusions (Mg—P oxide) in a molten metal, and some of the inclusions may fall off during a facing process, thereby causing a surface defect, such as a "shrinkage cavity".

Such a surface defect can be prevented with an aluminum-magnesium alloy plate according to an embodiment of the present invention, as described below.

In an aluminum-magnesium alloy plate (for use in a thick plate) according to an embodiment of the present invention, Cr and/or Ca added to the aluminum-magnesium alloy preferentially binds P and reduces the percentage of P that binds Mg. This can suppress the formation of Mg phosphide and consequently suppress the formation of a Mg—P oxide (an inclusion). Thus, such a surface defect as described above can be prevented.

An aluminum-magnesium alloy plate (for use in a thick plate) according to an embodiment of the present invention is made of an Al—Mg alloy that contains 1.0 to 5.5 mass % Mg and P as an unavoidable impurity and to which at least one of 0.20 mass % or more Cr and 0.002 mass % or more Ca is added.

The reasons for limiting the Cr and Ca contents are described above.

(Mg: 1.0 to 5.5 Mass %: Al—Mg Alloy Plate for Use in Thick Plate)

A Mg content of less than 1.0 mass % results in an insufficient strength of the thick plate. A Mg content of more than 5.5 mass % tends to result in cracking during hot rolling and is not suitable for product processing. Thus, the Mg content ranges from 1.0 to 5.5 mass %.

A Mg content of more than 2.5 mass % results in poor stress corrosion cracking (SCC) resistance. Thus, the Mg content preferably ranges from 1.0 to 2.5 mass % in terms of corrosion resistance.

The other components are not particularly limited. The components other than those described above may have a composition of alloy number 5052 or 5083 defined in JIS H4000. For example, the other components are Si: 0.25 mass % or less, Fe: 0.4 mass % or less, Cu: 0.1 mass % or less, Mn: 0.5 mass % or less, Zn: 0.3 mass % or less, Ti: 0.1 mass % or less, and the remainder of Al and unavoidable impurities. Examples of the unavoidable impurities include B, Zr, and V.

A method for manufacturing an Al—Mg alloy plate (for use in a thick plate) may be, but is not limited to, a conventional method.

For example, an Al—Mg alloy plate (for use in a thick plate) is manufactured by melting a predetermined alloy, adding the predetermined amount of Cr and/or Ca to the molten alloy, producing an ingot (alloy) through a DC casting process, and subjecting the ingot to soaking and rough hot rolling. After the rough hot rolling, the Al—Mg alloy plate (for use in a thick plate) may be subjected to finish hot rolling, if necessary, and after the finish hot rolling may be subjected to cold rolling, if necessary.

[Aluminum-Magnesium Alloy Plate for Shape Processing]

When Al—Mg alloys manufactured by using raw materials containing aluminum scrap are used as plate materials for shape processing (automobile panel materials), the presence of an excessive amount of P results in a great number of inclusions (Mg—P oxide) in a molten metal, and some of the inclusions may fall off during press working, thereby causing a surface defect, such as a "shrinkage cavity".

Such a surface defect can be prevented with an aluminum-magnesium alloy plate according to an embodiment of the present invention, as described below.

In an aluminum-magnesium alloy plate (for use in shape processing) according to an embodiment of the present invention, Cr and/or Ca added to the aluminum-magnesium alloy preferentially binds P and reduces the percentage of P that binds Mg. This can suppress the formation of Mg phosphide and consequently suppress the formation of a Mg—P oxide (an inclusion). Thus, such a surface defect as described above can be prevented.

An aluminum-magnesium alloy plate (for use in shape processing) according to an embodiment of the present invention is made of an Al—Mg alloy that contains Mg: 6.0 to 15.0 mass % and P as an unavoidable impurity and to which at least one of 0.20 mass % or more Cr and 0.002 mass % or more Ca is added.

The reasons for limiting the Cr and Ca contents are described above.

(Mg: 6.0 to 15.0 Mass %: Al—Mg Alloy Plate for Use in Shape Processing)

A Mg content of less than 6.0 mass % results in an insufficient strength of a plate material for shape processing (automobile panel material). A Mg content of more than 15.0 mass % results in poor formability and is not suitable for practical use.

Thus, the Mg content ranges from 6.0 to 15.0 mass %.

The other components are not particularly limited. The components other than those described above preferably constitute a high-Mg-content Al—Mg alloy that contains at least one element of Fe: 1.0 mass % or less, Si: 0.5 mass % or less, Ti: 0.1 mass % or less, B: 0.05 mass % or less, Mn: 0.3 mass % or less, Zr: 0.3 mass % or less, V: 0.3 mass % or less, Cu: 1.0 mass % or less, and Zn: 1.0 mass % or less as an impurity.

A method for manufacturing an Al—Mg alloy plate (for use in shape processing) may be, but is not limited to, a conventional method.

For example, an Al—Mg alloy plate (for use in shape processing) is manufactured by melting a predetermined alloy, adding the predetermined amount of Cr and/or Ca to the molten alloy, producing an ingot (alloy) through a DC casting process, subjecting the ingot to soaking and hot rolling (rough rolling, finish rolling), and cold rolling the hot-rolled plate.

EXAMPLES

An aluminum-magnesium alloy and an alloy plate thereof according to the present invention will be further described by comparing Examples that comply with the requirements set forth herein with Comparative Examples that do not comply with the requirements.

[Samples]

A sample A (Mg: 1.0 to 5.5 mass %) and a sample B (Mg: 6.0 to 15.0 mass %) were prepared. The sample A was an Al—Mg alloy supposed to be used as a plate material for a thick plate. The sample B was an Al—Mg alloy supposed to be used as a plate material for shape processing. Predetermined amounts of P and Cr and/or Ca were added to each of the samples, and the aluminum-magnesium alloy was casted in a mold.

[Test Method]

After predetermined amounts of P and Cr and/or Ca were added to the aluminum-magnesium alloy, a molten aluminum-magnesium alloy (sample) taken from a launder with a ladle immediately before the molten metal was casted was casted in a mold approximately 45 mm in diameter and approximately 30 mm in height and was cooled to form a sample cast billet. The casting surface of the cast billet was cut with a lathe, for example. The smoothed surface was subjected to a quantitative analysis of P and other elements using glow discharge mass spectrometry. Quantitative analyses of a plate material for a thick plate and a plate material for shape processing (product plate) using glow discharge mass spectrometry gave the same values.

Tables 1 and 2 show the results of the quantitative analysis performed using glow discharge mass spectrometry in accordance with the test method described above. The Bi content and the Be content were determined in the same manner. The Bi content and the Be content of all the samples were 0 mass % (0 ppm).

After 50 g of a sample to which predetermined amounts of P and Cr and/or Ca were added was melted, oxides on the molten metal surface were removed. The sample was then held at 730° C. in the ambient atmosphere for one hour and was cooled. The number of oxides on the molten metal surface and the average oxide size (equivalent circular diameter) were determined. The number of oxides and the average oxide size were determined by observing 20 visual fields (2.4 $mm^2$ in total) with a scanning electron microscope (SEM) at a magnification of 350 and taking an average.

Figure 2:
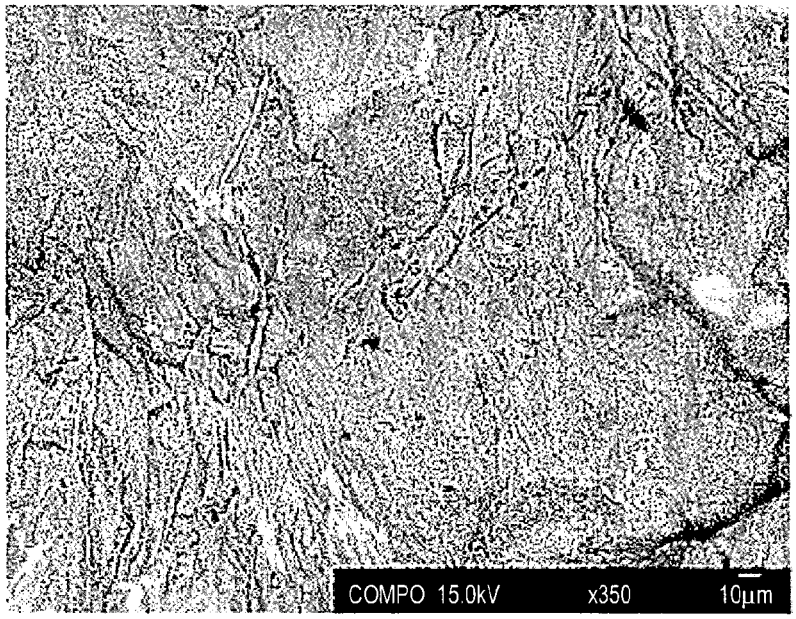
FIG. 2 shows images of a molten metal surface of a different solidified sample taken with a scanning electron microscope.
Figure 2:
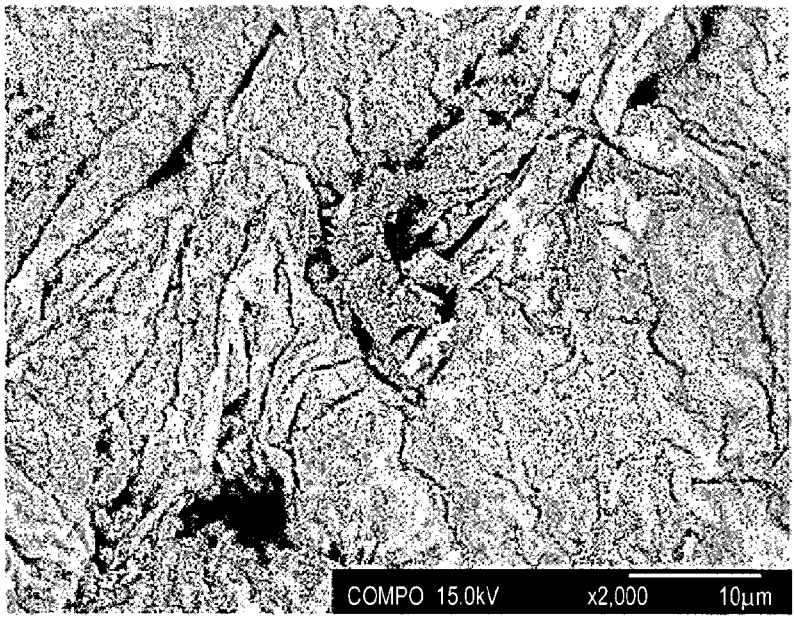
Figure 3:
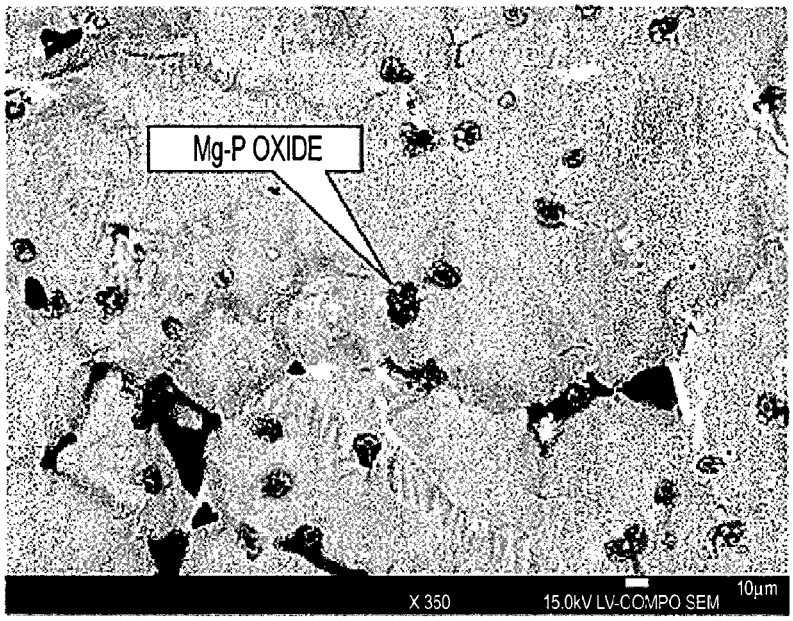
FIG. 3 shows images of a molten metal surface of another different solidified sample taken with a scanning electron microscope.
Figure 3:
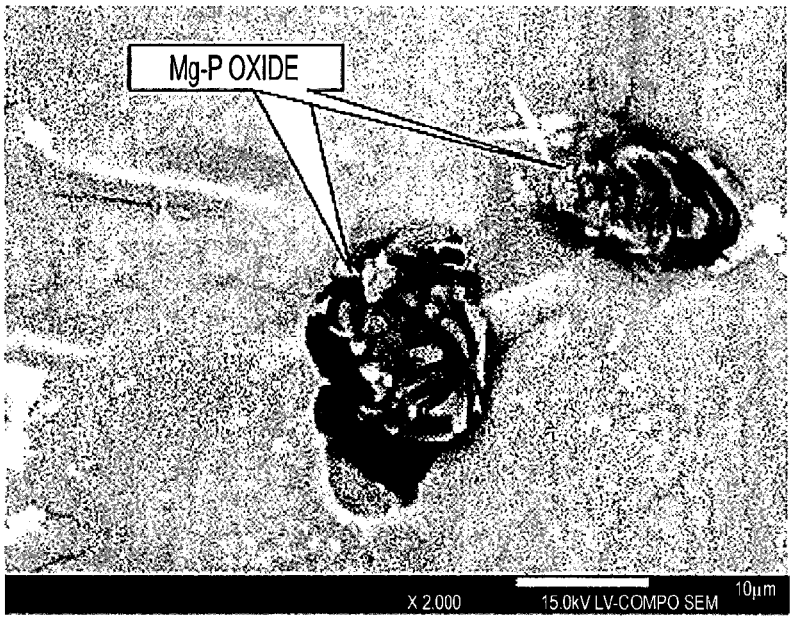

Tables 1 and 2 show the compositions of the samples and test results in detail. In Tables 1 and 2, the underlined values are outside the scope of the present invention. FIGS. 1 to 3 show examples of scanning electron microscope (SEM) observation.

In the scanning electron microscope (SEM) observations in FIGS. 1 to 3, the "low-magnification SEM" images were observed at a magnification of 350, and the "high-magnification SEM" images were observed at a magnification of 2000.

TABLE 1

| Classification | Sample | Mg (mass %) | Cr (mass %) | Ca (mass %) | P (mass %) | Si (mass %) | Fe (mass %) | Cu (mass %) | Mn (mass %) | Zn (mass %) | Ti (mass %) | Al (mass %) | Number of oxides on molten metal surface (/mm$^2$) | Average oxide size on molten metal surface (μm) | Plate surface appearance |
|---|---|---|---|---|---|---|---|---|---|---|---|---|---|---|---|
| Example 1-1 | A | 2.4 | 0.2 | — | 0.005 | — | 0.22 | — | 0.25 | — | — | Bal. | 20 | 5 | Good |
| Example 1-2 | A | 2.5 | — | 0.002 | 0.005 | 0.08 | — | 0.05 | — | 0.25 | 0.03 | Bal. | 0 | — | Good |
| Example 1-3 | A | 2.4 | — | 0.003 | 0.005 | 0.06 | 0.31 | — | 0.50 | — | 0.03 | Bal. | 0 | — | Good |
| Example 1-4 | A | 1.0 | 0.2 | — | 0.005 | 0.69 | 0.20 | 0.35 | 0.05 | 0.10 | 0.03 | Bal. | 13 | 5 | Good |
| Example 1-5 | A | 1.0 | — | 0.002 | 0.005 | 0.69 | 0.20 | 0.35 | 0.05 | 0.10 | 0.03 | Bal. | 0 | — | Good |
| Comparative example 1-6 | A | 2.4 | 0.1 | 0.001 | 0.005 | 0.08 | — | 0.05 | — | 0.25 | 0.03 | Bal. | 225 | 20 | Shrinkage cavity |
| Comparative example 1-7 | A | 1.0 | 0.1 | 0.001 | 0.005 | 0.69 | 0.20 | 0.35 | 0.05 | 0.10 | 0.03 | Bal. | 218 | 20 | Shrinkage cavity |
| Example 3-1 | A | 4.2 | 0.2 | — | 0.005 | — | 0.22 | — | 0.25 | — | — | Bal. | 20 | 5 | Good |
| Example 3-2 | A | 4.8 | — | 0.002 | 0.005 | 0.08 | — | 0.05 | — | 0.25 | 0.03 | Bal. | 0 | — | Good |
| Example 3-3 | A | 5.5 | — | 0.003 | 0.005 | 0.06 | 0.31 | — | 0.50 | — | 0.03 | Bal. | 0 | — | Good |
| Example 3-4 | A | 5.3 | 0.1 | 0.001 | 0.005 | 0.08 | — | 0.05 | — | 0.25 | 0.03 | Bal. | 225 | 20 | Shrinkage cavity |

TABLE 2

| Classification | Sample | Mg (mass %) | Cr (mass %) | Ca (mass %) | P (mass %) | Si (mass %) | Fe (mass %) | Cu (mass %) | Mn (mass %) | Zn (mass %) |
|---|---|---|---|---|---|---|---|---|---|---|
| Example 2-1 | B | 6 | 0.2 | — | 0.005 | 0.3 | 0.4 | 0.05 | 0.3 | 0.3 |
| Example 2-2 | B | 6 | — | 0.003 | 0.005 | 0.3 | 0.4 | 0.05 | 0.3 | 0.3 |
| Example 2-3 | B | 10 | 0.2 | — | 0.005 | 0.21 | 0.25 | 0.8 | 0.2 | 0.2 |
| Example 2-4 | B | 10 | — | 0.003 | 0.005 | 0.21 | 0.25 | — | — | — |
| Example 2-5 | B | 15 | — | 0.002 | 0.005 | — | — | 0.8 | 0.2 | 0.2 |
| Example 2-6 | B | 15 | 0.2 | — | 0.005 | 0.08 | 0.2 | 0.03 | 0.1 | 0.1 |
| Comparative example 2-7 | B | 6 | 0.1 | 0.001 | 0.005 | 0.3 | 0.4 | 0.05 | 0.3 | 0.3 |
| Comparative example 2-8 | B | 10 | 0.1 | 0.001 | 0.005 | 0.21 | 0.25 | — | — | — |
| Comparative example 2-9 | B | 15 | 0.1 | 0.001 | 0.005 | 0.08 | 0.2 | 0.03 | 0.1 | 0.1 |
| Comparative example 2-10 | B | 17 | 0.1 | 0.001 | 0.005 | 0.21 | 0.25 | — | — | — |

| Classification | Ti (mass %) | Al (mass %) | Number of oxides on molten metal surface (/mm$^2$) | Average oxide size on molten metal surface (μm) | Casting process | Ingot thickness | Soaking | Bending workability |
|---|---|---|---|---|---|---|---|---|
| Example 2-1 | 0.02 | Bal. | 50 | 5 | DC | 45 mm | 450° C. × 6 hr | ○ |
| Example 2-2 | 0.02 | Bal. | 5 | 5 | DC | 45 mm | 450° C. × 6 hr | ○ |
| Example 2-3 | 0.01 | Bal. | 69 | 5 | DC | 45 mm | 450° C. × 6 hr | ○ |
| Example 2-4 | 0.01 | Bal. | 24 | 7 | Twin-roll | 5.5 mm | 450° C. × 1 s | ○ |
| Example 2-5 | — | Bal. | 37 | 7 | Twin-roll | 5.5 mm | 490° C. × 1 s | ○ |
| Example 2-6 | 0.01 | Bal. | 79 | 10 | Twin-roll | 5.5 mm | 460° C. × 1 s | ○ |
| Comparative example 2-7 | 0.02 | Bal. | 255 | 15 | DC | 45 mm | 450° C. × 6 hr | x |
| Comparative example 2-8 | 0.01 | Bal. | 274 | 30 | Twin-roll | 5.5 mm | 490° C. × 1 s | x |
| Comparative example 2-9 | 0.01 | Bal. | 284 | 30 | Twin-roll | 5.5 mm | 460° C. × 1 s | x |
| Comparative example 2-10 | 0.01 | Bal. | 295 | 30 | Uncastable | — | — | — |

[Examination of Results]

On the basis of the results in Tables 1 and 2, the alloys according to the examples were compared with the alloys according to the comparative examples. In the alloy plates according to the examples, in which at least the predetermined amount of Cr defined in the present application was added to the alloys, the number of oxides on the molten metal surface was 80 or less per square millimeter, and the average oxide size (μm) on the molten metal surface was 10 μm or less. In the alloy plates according to the examples, in which at least the predetermined amount of Ca defined in the present application was added to the alloys, the number of oxides on the molten metal surface was 40 or less per square millimeter, and the average oxide size (μm) on the molten metal surface was 10 μm or less.

In contrast, in the alloy plates according to the comparative examples, in which the amounts of added Cr and/or Ca were less than the values defined in the present invention, the number of oxides (/mm$^2$) on the molten metal surface was much more than 80 per square millimeter and was more than 240 per square millimeter in many comparative examples. The average oxide size (μm) on the molten metal surface was 15 μm in one comparative example and 30 μm in other comparative examples.

The oxides were identified with an energy dispersive X-ray spectrometer (EDX) attached to a scanning electron microscope (SEM). The EDX measurement of the oxides on the molten metal surface of the alloys according to the comparative examples showed that the oxides contained Mg, P, and O as components and were complex oxides of Mg and P. The SEM observation of a cross section at the bottom of the sample showed the presence of the complex oxides of Mg and P, indicating that the oxides on the molten metal surface were present as precipitated or suspended inclusions in the molten metal.

The scanning electron microscope observations in FIGS. 1 to 3 showed that the sample to which 0.20 mass % Cr was added (Example 2-1) contained a very few Mg—P oxides (inclusions) having a relatively small size on the surface. The sample to which 0.003 mass % Ca was added (Example 2-2) contained few Mg—P oxides (inclusions). In contrast, the sample to which 0.1 mass % Cr and 0.001 mass % Ca were added (Comparative Example 2-7) contained many Mg—P oxides (inclusions) having a relatively large size on the surface thereof.

Thus, the addition of at least a predetermined amount of Cr and/or Ca can suppress the molten metal oxidation of Mg without the addition of Be, allowing a high-quality Al—Mg alloy to be manufactured.

(Plate Material for Thick Plate: Results)

The alloys in Table 1 were melted, subjected to dehydrogenation treatment, and filtered. An ingot having a thickness of 500 mm was manufactured from each of the alloys through a DC casting process. The ingot was homogenized at a soaking temperature of 500° C. for 4 hours and was then hot-rolled (rough and finish) to form a hot-rolled aluminum alloy plate having a thickness of approximately 25 mm. The hot-rolled aluminum alloy plate was cut into a piece 2000 mm in length and 1000 mm in width in the rolling direction. The rolled surfaces (both sides) were smoothed by end milling. An aluminum alloy thick plate having a thickness of 20 mm (cut plate) was thus formed. An anodized aluminum film having a thickness of 10 μm was formed on the surfaces of the aluminum alloy thick plate through sulfuric acid anodized aluminum treatment (15% sulfuric acid, 20° C., an electric current density of 2 A/dm$^2$).

Forty thick plates were manufactured in this manner. Surfaces of the thick plates were observed with the naked eye. In the case that there was no plate having a surface defect of a "shrinkage cavity" on the surface thereof, the plate surface appearance was rated "good". In the case that there was at least one plate having a surface defect of a "shrinkage cavity" on the surface thereof, the plate surface appearance was rated to be a "shrinkage cavity" (defective).

Thick plates made of the alloys according to Examples 1-1 to 1-5 and Examples 3-1 to 3-3 listed in Table 1 had a good surface with no surface defect of a "shrinkage cavity".

In contrast, thick plates made of the alloys according to Comparative Examples 1-6 and 1-7 and Comparative Example 3-4 listed in Table 1 had a "shrinkage cavity" on the surface thereof because an inclusion (Mg—P oxide) fell off during cutting or smoothing treatment.

Such a surface defect becomes a functional defect in applications in which vacuum chambers are used. In applications in which vacuum chambers are used, plates are rarely used without treating the surface thereof and are generally subjected to alumite treatment or plating treatment in order to improve corrosion resistance or weatherability. However, an anodized aluminum film cannot be successfully formed on such a surface defect. When a component of a vacuum apparatus chamber has such a defect, gas atoms dissolved in the component can be released through the surface under high vacuum, thereby reducing the degree of vacuum.

This increases the time required to reach the target degree of vacuum and thereby reduces production efficiency.

(Plate Material for Shape Processing: Results)

An alloy listed in Table 2 was melted. A predetermined amount of Cr and/or Ca was added to the molten alloy. The molten alloy was casted into an ingot having a predetermined thickness through a DC casting process or a twin-roll continuous casting process. In the twin-roll continuous casting process, an aluminum alloy thin plate ingot was subjected to soaking under the conditions shown in Table 2 and was cold-rolled to a thickness of 1.0 mm without hot rolling. In the DC casting process, an aluminum alloy thin plate ingot was subjected to soaking under the conditions shown in Table 2, was hot-rolled to a thickness of 4 mm from an initial temperature of 480° C. to a final temperature of 350° C., and was cold-rolled to a thickness of 1.0 mm. No intermediate annealing was performed during the cold rolling. The cold-rolled plate was finally annealed in a continuous annealing furnace at an annealing temperature of 450° C. (for 1 s or less) at a cooling rate of 20° C./s. In the twin-roll continuous casting, the twin-roll peripheral speed was 70 mm/min. The teeming temperature at which the molten aluminum alloy was poured into the twin-roll was 20° C. higher than the liquidus line temperature. The twin-roll surface was not lubricated. The alloy according to Comparative Example 2-10, which had a Mg content of 15% or more, had a casting crack because of the segregation of Mg and could not be formed into an ingot.

As a simulation of press forming and subsequent flat hemming of a panel, an aluminum alloy plate having a thickness of 1.00 mm manufactured in this manner was stretched by 10% at normal temperature and was subjected to a bending test at normal temperature. A No. 3 test specimen defined in JIS Z 2204 (30 mm in width and 200 mm in length) was prepared from the aluminum alloy plate. The longitudinal direction of the test specimen was the rolling direction. In the bending test, as a simulation of flat hemming, the test specimen was bent at 60 degrees with a pressing metal piece having a front edge radius of 0.3 mm and a bending angle of 60 degrees and was then bent at 180 degrees in accordance with a V-block method defined in JIS Z 2248.

The test specimen was checked for cracking of the bent portion (curved portion) after the bending test. After the bending test was performed 10 times (10 test specimens), test specimens having no crack on the surface of the bent portion were rated good (circle). In the case that at least one of the 10 test specimens had a crack, the test specimens were rated poor (cross).

The alloys according to Examples 2-1 to 2-6 in Table 2 had good bending workability in the bending test.

In contrast, the alloys according to Comparative Examples 2-7 to 2-9 in Table 2 had a crack on the surface of the bent portion in the bending test, and an inclusion (Mg—P oxide) was observed in the crack.

The invention claimed is:

1. An aluminum-magnesium alloy, comprising Al,
2.4 to 15 mass % Mg,
more than 0.001 mass % P as an unavoidable impurity, and
at least one of 0.20 mass % or more Cr and 0.002 mass % or more Ca.

2. An aluminum-magnesium alloy plate, comprising: the alloy according to claim 1,
wherein the aluminum-magnesium alloy plate has a Mg content of from 2.4 to 5.5 mass % and is utilized for a thick plate.

3. The aluminum-magnesium alloy plate according to claim 2, wherein the Mg content ranges from 2.4 to 2.5 mass %.

4. An aluminum-magnesium alloy plate, comprising: the alloy according to claim 1,
wherein the aluminum-magnesium alloy plate has a Mg content of from 6.0 to 15.0 mass % and is utilized for shape processing.

5. The aluminum-magnesium alloy according to claim 1, wherein a total content of Al and Mg is 90 mass % or more.

6. The aluminum-magnesium alloy according to claim 1, wherein the aluminum-magnesium alloy comprises Cr of 0.20 mass % or more and 0.3 mass % or less.

7. The aluminum-magnesium alloy according to claim 1, wherein the aluminum-magnesium alloy comprises Ca of 0.002 mass % or more and 0.1 mass % or less.

8. The aluminum-magnesium alloy according to claim 1, wherein the aluminum-magnesium alloy comprises P of 0.005 mass % or more.

9. The aluminum-magnesium alloy plate according to claim 2, wherein the Mg content ranges from 2.4 to 4.8 mass %.

10. The aluminum-magnesium alloy plate according to claim 2, wherein the Mg content ranges from 2.4 to 4.2 mass %.

11. The aluminum-magnesium alloy plate according to claim 4, wherein the Mg content ranges from 6.0 to 10.0 mass %.

12. The aluminum-magnesium alloy plate according to claim 4, wherein the Mg content ranges from 10.0 to 15.0 mass %.

13. An aluminum-magnesium alloy, comprising
Al,
1.0 to 5.5 mass % Mg,
more than 0.001 mass % P as an unavoidable impurity, and
at least one of 0.20 mass % or more Cr, 0.002 mass % or more Ca, and 0.25 mass % or less Si,
wherein the aluminum-magnesium alloy is utilized for a thick plate.

* * * * *